US010608375B2

(12) United States Patent
Homme et al.

(10) Patent No.: US 10,608,375 B2
(45) Date of Patent: Mar. 31, 2020

(54) CONNECTOR ASSEMBLY WITH A SLIDER

(71) Applicants: Tyco Electronics Japan G.K., Kawasaki (JP); Honda Motor Co., Ltd., Tokyo (JP)

(72) Inventors: Hidetaka Homme, Kawasaki (JP); Koji Inose, Wako (JP); Motoki Harada, Wako (JP); Yuichi Takeda, Wako (JP); Tadashi Niino, Wako (JP)

(73) Assignees: Tyco Electronics Japan G.K., Kawasaki-shi (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/359,241

(22) Filed: Mar. 20, 2019

(65) Prior Publication Data

US 2019/0214768 A1 Jul. 11, 2019

Related U.S. Application Data

(63) Continuation of application No. PCT/JP2017/034110, filed on Sep. 21, 2017.

(30) Foreign Application Priority Data

Sep. 29, 2016 (JP) ..... 2016-190603

(51) Int. Cl.
*H01R 13/62* (2006.01)
*H01R 13/629* (2006.01)
*H01R 12/72* (2011.01)

(52) U.S. Cl.
CPC ..... *H01R 13/62911* (2013.01); *H01R 12/72* (2013.01); *H01R 13/629* (2013.01); *H01R 13/62927* (2013.01)

(58) Field of Classification Search
CPC ..... H01R 13/62938; H01R 13/193; H01R 13/639; H01R 13/4223; G06K 13/08
(Continued)

(56) References Cited

U.S. PATENT DOCUMENTS 5,575,676 A * 11/1996 Tsukakoshi ..... H01R 13/62911 439/157
6,142,826 A * 11/2000 Bourillon ..... H01R 13/4364 439/157
(Continued)

FOREIGN PATENT DOCUMENTS

JP 11214070 A 8/1999
JP 2001143785 A 5/2001
(Continued)

OTHER PUBLICATIONS

International Search Report, dated Nov. 2, 2017, 2 pages.
(Continued)

*Primary Examiner* — Thanh Tam T Le
(74) *Attorney, Agent, or Firm* — Barley Snyder

(57) ABSTRACT

A connector assembly comprises a first connector and a second connector matable with the first connector in a mating direction. The first connector includes a housing and a slider held by the housing and slidable with respect to the housing in a direction intersecting the mating direction. The slider has a slider backlash restraining device disposed on an inner wall. The slider slides in a first direction to cause the second connector to move in the mating direction and slides in a second direction opposite to the first direction to cause the second connector to move in a direction opposite to the mating direction. The second connector has a connector backlash restraining device disposed on an outer wall of the second connector. The slider backlash restraining device
(Continued)

abuts the connector backlash restraining device when the first connector is mated with the second connector.

17 Claims, 6 Drawing Sheets

(58) Field of Classification Search
USPC ..... 439/157, 159, 342, 347, 595
See application file for complete search history.

(56) References Cited

U.S. PATENT DOCUMENTS 6,149,473 A * 11/2000 Lalange ..... H01R 13/4368 439/157
6,155,850 A * 12/2000 Martin ..... H01R 13/62911 439/157
6,382,992 B1 * 5/2002 Bouchan ..... H01R 13/62911 439/157
7,011,536 B2 * 3/2006 Okamoto ..... H01R 13/62911 439/157
7,347,704 B2 * 3/2008 Tsuji ..... H01R 13/62927 439/157
7,497,706 B2 * 3/2009 Daudin ..... H01R 13/514 439/157
8,297,993 B2 * 10/2012 Schmidt ..... H01R 13/62911 439/157
9,209,562 B2 12/2015 Kamiya
9,640,905 B2 5/2017 Suzuki
2004/0121640 A1 6/2004 Okamoto et al.

FOREIGN PATENT DOCUMENTS

JP 2004193014 A 7/2004
JP 2013143202 A 7/2013
JP 2015022809 A 2/2015
WO 2012053350 A1 4/2012
WO 2015086619 A1 6/2015

OTHER PUBLICATIONS

Abstract of JP 2015022809, dated Feb. 2, 2015, 1 page.
Abstract of JP 2004193014, dated Jul. 8, 2004, 1 page.
Abstract of JP2013143202, dated Jul. 22, 2013, 1 page.
Abstract of JP2001143785, dated May 25, 2001, 1 page.
Abstract of JPH 11214070, dated Aug. 6, 1999, 1 page.

* cited by examiner

CONNECTOR ASSEMBLY WITH A SLIDER

CROSS-REFERENCE TO RELATED APPLICATION

This application is a continuation of PCT International Application No. PCT/JP2017/034110, filed on Sep. 21, 2017, which claims priority under 35 U.S.C. § 119 to Japanese Patent Application No. 2016-190603, filed on Sep. 29, 2016.

FIELD OF THE INVENTION

The present invention relates to a connector assembly and, more particularly, to a connector assembly including a first connector with a slider and a second connector configured to mate with the first connector.

BACKGROUND

An electrical connector designed to have a reduced required force for mating is disclosed, for example, in International Patent Application No. WO 2015/086619 A. Another such connector 10' according to the prior art is shown in FIG. 8. The connector 10', as shown in FIG. 8, has a lever 11'. The lever 11' rotates around a rotation axis R in the direction of Arrows O-C between an open state shown in FIG. 8 and a closed state in which the connector 11' overlaps a housing 12.

When a mating connector 20' is mated to the connector 10', the lever 11' is in the open state shown in FIG. 8 and the mating connector 20' is inserted into the connector 10' in a mating direction. A pair of cam followers 21' each formed on a side in the width direction of the mating connector 20' enter a pair of cam grooves 111 each formed on a side in the width direction of the lever 11'. An operating section 112 of the lever 11' is then rotated in the direction of Arrow C up to the closed state in which the lever 11' overlaps the housing 12. The cam followers 21' are drawn in along the shape of the cam grooves 111 and the mating connector 20' mates with the connector 10'. The leverage principal works according to a ratio between the distance between the rotation axis R of the lever 11' and the cam grooves 111 and the distance between the rotation axis R and the operating section 112 of the lever 11'. This makes it possible to mate the connector 20' to the connector 10' with a low operating force. When the lever 11' is rotated up to the closed state, the lever 11' locks with a pair of locking protrusions 13 each provided on a side in the width direction of the housing 12 and the lever 11' is held in the closed state.

For the connector 10', the force required to mate with the mating connector 20' is reduced. However, adding the lever 11' leads to an increase in size. Further, the mating connector 20' is drawn in only at two positions in the width direction; a proceeding direction of the mating connector 20' may deviate from the mating direction and stable contact is not reliably obtained.

Japanese Patent Application No. 11-214070 A discloses a connector in which an engaging projection is arranged on a bottom of a slider. A guiding slit into which the engaging projection is inserted is disposed in a connector housing. The slider is prevented from position shifting.

A card edge connector has printed wirings arranged at an edge of a printed circuit board and used as contacts to electrically connect with a mating connector. A connector of the card edge connector type is so made that electrical components and the like mounted on a circuit board are sealed together therewith by resin, and thus, the connector becomes heavy and an integrated rigid body as a whole. When backlash occurs between the card edge connector and its mating connector due to vibration or the like, contacts may be rubbed and damaged, causing contact failures. If the mating connector uses a slider to obtain a low mating force, the slider will be interposed between the card edge connector and a housing of the mating connector. The slider is arranged to form a gap between the slider and the housing for smooth sliding. For this reason, however, backlash may occur between the connectors in a mated state and may exacerbate undesirable electrical performance effects. However, effects due to such backlash are common to a case in which a slider is used to obtain a low mating force, and not limited to a case of the card edge connector type.

SUMMARY

A connector assembly comprises a first connector and a second connector matable with the first connector in a mating direction. The first connector includes a housing and a slider held by the housing and slidable with respect to the housing in a direction intersecting the mating direction. The slider has a slider backlash restraining device disposed on an inner wall. The slider slides in a first direction to cause the second connector to move in the mating direction and slides in a second direction opposite to the first direction to cause the second connector to move in a direction opposite to the mating direction. The second connector has a connector backlash restraining device disposed on an outer wall of the second connector. The slider backlash restraining device abuts the connector backlash restraining device when the first connector is mated with the second connector.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
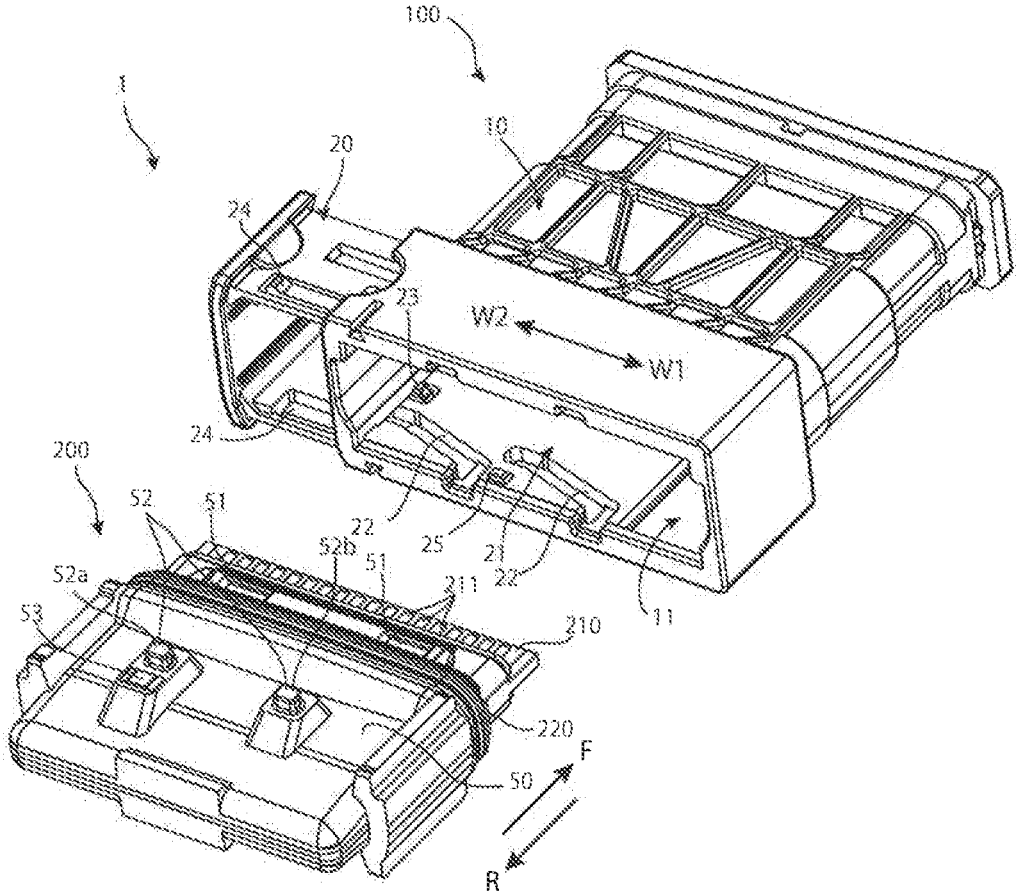
FIG. 1 is a perspective view of a connector assembly according to an embodiment in a before mating state.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

A connector assembly 1 according to an embodiment is shown in FIGS. 1-3 and 5-7. The connector assembly 1 includes a first connector 100 and a second connector 200 matable with the first connector 100.

The first connector 100, as shown in FIG. 1, includes a housing 10 and a slider 20. The housing 10 has a first receiving space 11 to receive the second connector 200. The second connector 200 is inserted in a mating direction F into the first receiving space 11.

Figure 6:
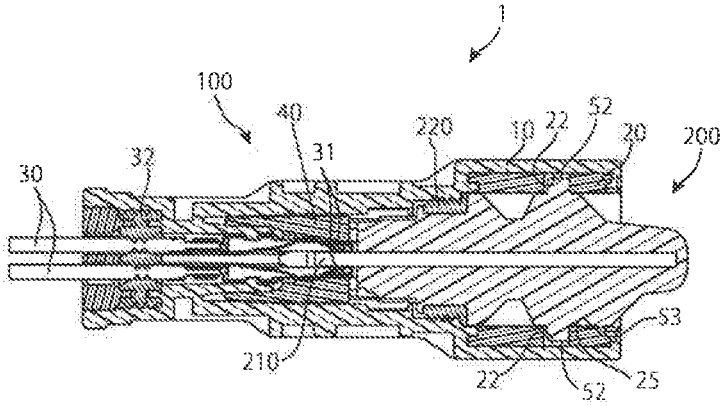
FIG. 6 is a sectional side view of the connector assembly in the fully mated state taken along line X2-X2 of FIG. 4.
Figure 7:
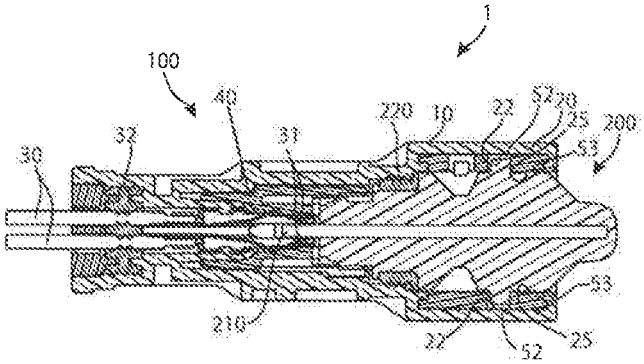
FIG. 7 is a sectional side view of the connector assembly in the fully mated state taken along line X3-X3 of FIG. 4.
Figure 8:
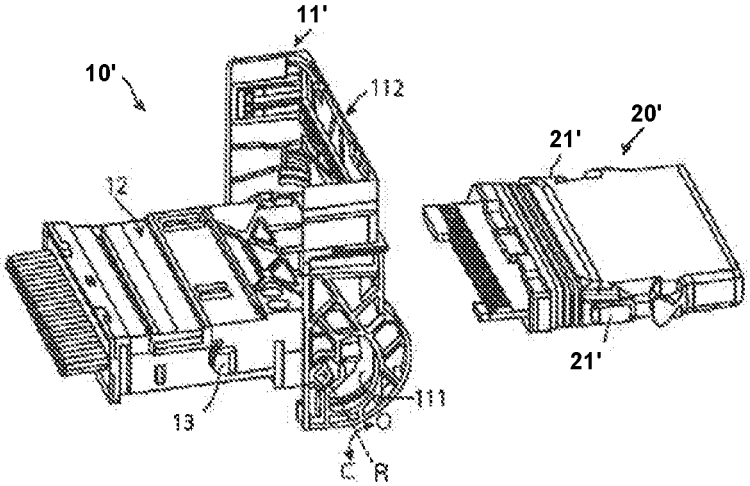
FIG.8 PRIOR ART
FIG. 8 is a perspective view of a connector having a lever according to the prior art.

A plurality of cables 30, as shown in FIGS. 6 and 7, are inserted from a rear side of the housing 10. A plurality of terminals 31 are connected by crimping to core wires of the cables 30. Each of the cables 30 is surrounded by a waterproof member 32 to prevent water from entering an inside of the housing 10.

As shown in FIG. 1, the slider 20 is held by the housing 10 such that the slider 20 is slidable in a width direction W1-W2 which is perpendicular to and intersects the mating direction F. The slider 20 is formed in an approximate U-shape, forming a second receiving space 21 in the first receiving space 11 formed in the housing 10. The slider 20 includes a plurality of cam grooves 22. In the embodiment shown in FIG. 1, two cam grooves 22 are disposed in a lower face of an inner wall of the slider 22. Two similar cam grooves 22 are also disposed in an upper face of the inner wall of the slider 20.

The slider 20, as shown in FIG. 1, includes first locking sections 23 and second locking sections 24. The first locking sections 23 are arranged one by one in a top and a bottom of the slider 20, extend in a cantilever form in a first direction W1, and include protrusions on tips which protrude in an inside of the second receiving space 21. The top and bottom first locking sections 23 lock with the housing 10 in a before-mating state, to prevent the slider 20 from easily coming out the housing 10. The second locking sections 24 are also arranged one by one in the top and the bottom of the slider 20. The top and bottom second locking sections 24 extend in a cantilever form in a second direction W2 opposite to that of the first locking sections 23, and include protrusions on tips thereof which protrude outward. The top and bottom locking sections 24 lock with the housing 10 in a mated state shown in FIG. 3, maintaining the mated state.

As shown in FIG. 1, a plurality of first protrusions 25 are formed on the inner wall of the slider 20. The first protrusions 25 are disposed one by one on the upper face and the lower face of the inner wall of the slider 20, and protrude in the inside of the second receiving space 21. The upper and lower protrusions 25 are provided at locations different from each other with respect to the width direction W1-W2.

The second connector 200, as shown in FIG. 1, has an edge section along a side of a circuit board 210 exposed in a tip section on a side of the first connector 100. A whole of the second connector 200 except for the exposed edge section of the circuit board 210 is covered with resin 50 together with circuit components mounted on the circuit board 210. Connecting pads 211 formed by printed wirings are arranged on the exposed edge section of the circuit board 210. The connecting pads 211 are male terminals to electrically connect to the terminals 31. In the shown embodiment, the second connector 200 is a card edge connector. In other embodiments, the second connector 200 may be any type of connector used in a connector assembly 1 with a slider 20.

Figure 5:
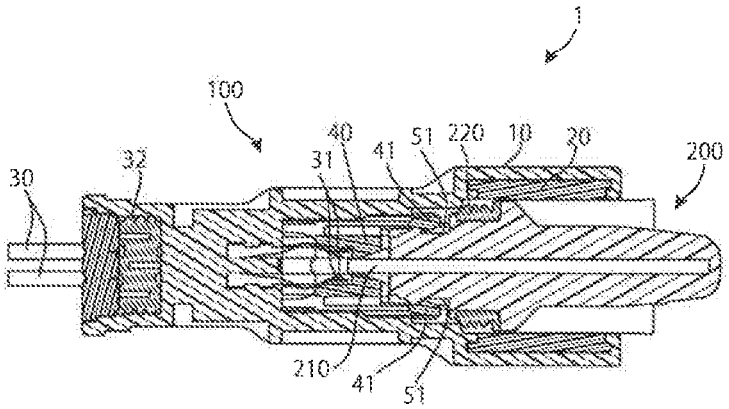
FIG. 5 is a sectional side view of the connector assembly in the partially mated state taken along line X1-X1 of FIG. 4.

The terminals 31 are pressed toward the circuit board 210 by a spacer 40, shown in FIGS. 5-7, which is movably accommodated in the housing 10, to contact the connecting pads 211. The spacer 40 is pressed by the second connector 200 moving in the mating direction F by an operation of the slider 20, to move leftward in FIG. 6 so as to press the terminals 31.

As shown in FIG. 1, depressed sections 51 are formed two by two on a top and a bottom in a tip portion covered by the resin 50 of the second connector 200. The depression sections 51 form a temporary lock in a partially mated state. As shown in FIG. 5, the spacer 40 of the first connector 100 includes on tips thereof third locking sections 41 respectively including protrusions protruding inward and extending in a cantilever form in a withdraw direction R shown in FIG. 1. In the partially mated state shown in FIG. 2, the protrusions on the tips of the third locking sections 41 enter the depression sections 51 of the second connector 200, temporarily locking in the partially mated state.

Figure 2:
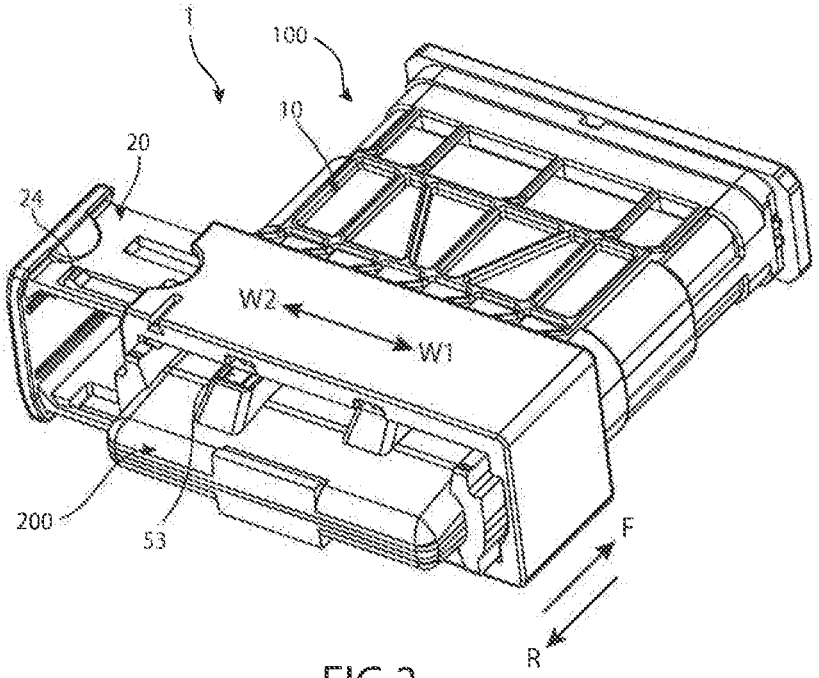
FIG. 2 is a perspective view of the connector assembly in a partially mated state.
Figure 3:
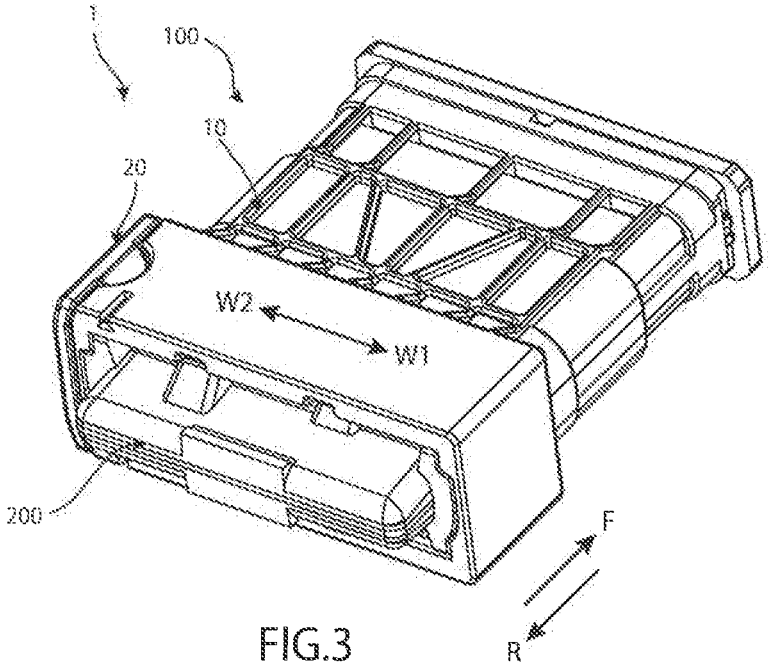
FIG. 3 is a perspective view of the connector assembly in a fully mated state.
Figure 4:
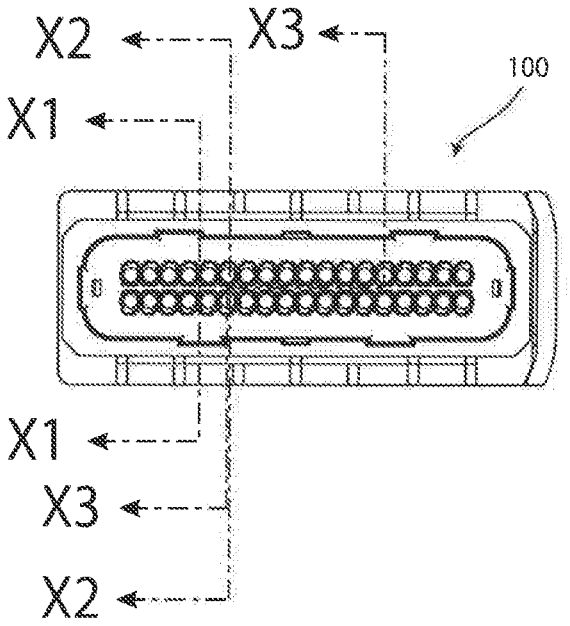
FIG. 4 is a rear view of a first connector of the connector assembly.

As shown in FIG. 1, a waterproof member 220 circumferentially surrounding the resin 50 is arranged slightly more rearward than the depression sections 51 on the second connector 200. In addition, further rearward, a pair of bosses 52 protrude outward from an upper face of an outer wall of the second connector 200. Similarly, two bosses 52 are also provided on a lower face, in addition to the upper face, of the outer wall of the second connector 200. The two bosses 52 provided on the lower face of the outer wall of the second connector 200 enter the two cam grooves 22 provided in the lower face of the inner wall of the slider 20, respectively. Similarly, the two bosses 52 provided on the upper face of the outer wall of the second connector 200 enter the two cam grooves 22 provided in the upper face of the inner wall of the slider 20. Each of the bosses 52 enters each of the cam grooves 22 to slide the slider 20 in the first direction W1. The second connector 200 is then drawn into the inside of the first connector 100 in accordance with the shape of the cam grooves 22 as shown in FIGS. 2 and 3. If the slider 20 is drawn out in the second direction W2 from a mated state of the first connector 100 and the second connector 200 shown in FIG. 3, the second connector 200 is moved out in the withdraw direction R opposite to the mating direction F.

In the second connector 200, as shown in FIG. 1, a second protrusion 53 protrudes outward at a location adjacent to a boss 52*a* on the left side of the two bosses 52 on the upper face of the outer wall. Another second protrusion 53 is also provided on the lower face of the outer wall of the second connector 200. However, the second protrusion 53 which is provided on the lower face of the outer wall is not provided right under the second protrusions 53 on the upper face of the outer wall. The second protrusion 53 is provided on the lower face of the outer wall at a location which, if the second connector 200 were upside down, the second protrusion 53 of the lower face of the outer wall is in a same location as the second protrusion 53 shown in FIG. 1. In other words, the second protrusion 53 on the lower face of the outer wall is provided at a location aligned with a boss 52*b* on the upper face of the outer wall.

The second protrusion 53 on the lower face of the outer wall moves onto the first protrusion 25 on the lower face of the inner wall of the slider 20 in the mated state shown in FIG. 3. The first protrusion 25 on the upper face of the inner wall of the slider 20 vertically overlaps the second protrusion 53 provided on the upper face of the inner wall of the second connector 200 in the mated state. In the mated state, the first protrusions 25 are pressed by the second protrusions 53 to expand the second receiving space 21 vertically.

FIG. 6 shows a state in which the first protrusion 25 provided on the lower face of the inner wall of the slider 20 and the second protrusion 53 provided on the lower face of the outer wall of the second connector 200 vertically overlap each other. Because the locations at which the first protrusions 25 are provided and the locations at which the second protrusions 53 are provided are different from each other between the upper face and the lower face, the first protrusion 25 and the second protrusion 53 on the upper face side are not shown in FIG. 6. The second connector 200 is held by the slider 20 at locations remote from the locations where the first protrusions 25 and the second protrusions 53 overlap each other, for example, at locations near the waterproof member 200. These configurations also contribute to restraining backlash between the second connector 200 and slider 20. In FIG. 7, positions of cross sections are different between the upper half and the lower half to illustrate the first protrusions 25 and the second protrusions 53 respectively overlapping each other both on the upper side and on the lower side.

In the mated state shown in FIG. 3, the first protrusions 25 provided on the slider 20 are pressed by the second protrusions 53 provided on the second connector 200, so that the upper wall of the slider 20 is pressed upward and the lower wall of the slider 20 is pressed downward. The outer walls of the slider 20 thus abut against the faces of the inner wall of the housing 10. In this way, in the mated state, not only backlash between the second connector 200 and the slider 20 is restrained, but backlash between the slider 20 and the housing 10 is also restrained. The first protrusions 25 of the slider 20 may also be referred to as a slider backlash restraining device 25 and the second protrusions 53 of the second connector 200 may also be referred to as a connector backlash restraining device 53.

What is claimed is:

1. A connector assembly, comprising:

a first connector including a housing having a first receiving space and a slider forming a second receiving space in the first receiving space, the slider is held by the housing and is slidable with respect to the housing in a direction intersecting a mating direction, the slider has a slider backlash restraining device disposed on an inner wall of the slider; and a second connector matable with the first connector in the mating direction and received in the first receiving space and the second receiving space, the slider slides in a first direction to cause the second connector to move in the mating direction and slides in a second direction opposite to the first direction to cause the second connector to move in a direction opposite to the mating direction, the second connector has a connecting pad formed as a male terminal on a circuit board and a connector backlash restraining device disposed on an outer wall of the second connector, the slider backlash restraining device abuts the connector backlash restraining device when the first connector is mated with the second connector.

2. The connector assembly of claim 1, wherein the slider backlash restraining device is a first protrusion disposed on the inner wall of the slider and protruding into an inside of the second receiving space.

3. The connector assembly of claim 2, wherein the connector backlash restraining device is a second protrusion is disposed on the outer wall of the second connector and protruding outward.

4. The connector assembly of claim 3, wherein the second protrusion presses the first protrusion in a direction to expand the second receiving space when the first connector is mated with the second connector.

5. The connector assembly of claim 4, wherein the slider abuts an inner wall of the housing when the second protrusion abuts the first protrusion.

6. The connector assembly of claim 5, wherein the slider backlash restraining device is a plurality of first protrusions disposed on an upper face and a lower face of the inner wall of the slider.

7. The connector assembly of claim 6, wherein the first protrusions disposed on the upper face of the inner wall are disposed in a different location in the first direction than the first protrusions disposed on the lower face of the inner wall.

8. The connector assembly of claim 5, wherein the connector backlash restraining device is a plurality of second protrusions disposed on the outer wall of the second connector.

9. The connector assembly of claim 8, wherein one of the second protrusions is disposed on an upper face of the outer wall of the second connector and another one of the second protrusions is disposed on a lower face of the outer wall of the second connector.

10. The connector assembly of claim 9, wherein the second protrusion disposed on the upper face of the outer wall is disposed in a different location in the first direction than the second protrusion disposed on the lower face of the outer wall.

11. The connector assembly of claim 1, wherein the first connector is a card edge connector adapted to receive an edge of the circuit board.

12. The connector assembly of claim 1, wherein the slider has a plurality of cam grooves disposed on the inner wall of the slider.

13. The connector assembly of claim 12, wherein the second connector has a plurality of bosses disposed on the outer wall of the second connector, the bosses entering the cam grooves to move the second connector in the mating direction and in the direction opposite to the mating direction.

14. The connector assembly of claim 1, wherein the slider has a plurality of first locking sections engaging the housing in a before mating state.

15. The connector assembly of claim 14, wherein the slider has a plurality of second locking sections engaging the housing in a mated state when the first connector is mated with the second connector.

16. A connector assembly, comprising:

a first connector including a housing, a slider, and a spacer, the housing having a first receiving space, the slider forming a second receiving space in the first receiving space, the slider is held by the housing and is slidable with respect to the housing in a direction intersecting a mating direction, the slider has a slider backlash restraining device disposed on an inner wall of the slider, and the spacer movably disposed in the housing, and having a locking section disposed on an end of the spacer; and a second connector matable with the first connector in the mating direction and received in the first receiving space and the second receiving space, the slider slides in a first direction to cause the second connector to move in the mating direction and slides in a second direction opposite to the first direction to cause the second connector to move in a direction opposite to the mating direction, the second connector has a connector backlash restraining device disposed on an outer wall of the second connector, the slider backlash restraining device abuts the connector backlash restraining device when the first connector is mated with the second connector.

17. The connector assembly of claim 16, wherein the second connector has a depressed section engaging the locking section of the spacer to form a temporary lock of the second connector to the first connector in a partially mated state.

* * * * *